United States Patent [19]

Engler et al.

[11] 4,205,589

[45] Jun. 3, 1980

[54] WEAPON CONTROL AND FIRING SYSTEM

[76] Inventors: Richard D. Engler, 3001 Hewitt Ave., Silver Spring, Md. 20906; David M. Hudak, 14520 Lock Dr., Centreville, Va. 22020; Andrew McKean, 307 Meadow Hall Dr., Rockville, Md. 20851

[21] Appl. No.: 962,098

[22] Filed: Nov. 20, 1978

Related U.S. Application Data

[63] Continuation of Ser. No. 842,102, Oct. 14, 1977, abandoned.

[51] Int. Cl.[2] ..... F41C 27/00

[52] U.S. Cl. ..... 89/41 SW; 42/84

[58] Field of Search ..... 42/84; 89/28 R, 41 SW, 89/41 ME, 135

[56] References Cited

U.S. PATENT DOCUMENTS

| | | | |
|---|---|---|---|
| 1,438,833 | 12/1922 | Kaminski | 89/28 R |
| 2,472,136 | 6/1949 | Whitlock | 89/28 R |
| 2,763,856 | 9/1956 | Lattmann | 343/7 G |
| 3,049,056 | 8/1962 | Evans et al. | 89/1 |
| 3,298,023 | 1/1967 | Prestwood | 343/6.5 R |
| 3,400,393 | 12/1966 | Ash | 343/6.5 R |
| 3,568,199 | 3/1979 | Hartness | 343/225 |

FOREIGN PATENT DOCUMENTS

| | | | |
|---|---|---|---|
| 2308897 | 11/1976 | France | 42/84 |

*Primary Examiner*—Stephen C. Bentley

*Attorney, Agent, or Firm*—Roylance, Abrams, Berdo & Farley

[57] ABSTRACT

A plurality of weapons are provided with electrically operated firing devices and radio transmitting and receiving equipment which permits each weapon to be fired only when the weapon trigger is depressed and a specific command signal is received by the weapon. A master control unit permits an operator to select necessary conditions which are to be satisfied before giving the command, including numbers of groups and weapons to be employed and numbers thereof which are to be in firing position with triggers depressed. Switching and logic arrangements are disclosed to permit the selection, receive signals from the weapons, recognize satisfaction of the conditions, and give the command simultaneously to all ready weapons.

5 Claims, 8 Drawing Figures

WEAPON CONTROL AND FIRING SYSTEM

This is a continuation of application Ser. No. 842,102, filed Oct. 14, 1977, now abandoned.

This invention relates to a weapon control system and, more particularly, to a system for simultaneously actuating a chosen number of weapons.

BACKGROUND OF THE INVENTION

The increase in recent years of illegal and highly dangerous activities by terrorist groups has created serious problems for law enforcement agencies. One of the most difficult circumstances to handle is that in which a group of armed individuals takes a number of victims hostage and attempts to use the hostages as protection and leverage to obtain transportation to a point of refuge.

A typical example of such a case is presented when a group of hostage takers kidnaps and holds, at gunpoint, a group of hostages and demands of a governmental agency that they be provided with an aircraft and crew and be flown, together with the hostages, to some remote location at which the hostage takers are, or believe they are, welcome. In such case it is obviously important to rescue the hostages and deactivate the hostage takers before they enter the aircraft, and it is not always possible to simply refuse the demands with the hope that the hostage takers are bluffing. Furthermore, it is frequently the case that the demands are made while the hostages and hostage takers are concealed in a protected location near or at an airport. It therefore becomes apparent that there will be a very limited interval of time in which the hostage takers are exposed, namely, that interval in which they are passing between a protected position such as a hanger or other building and the aircraft.

However, during that interval it can be expected that the hostages will be held at gunpoint and that any evidence of efforts to stop the proceedings will result in one or more of the hostages being killed or seriously injured, an unacceptable situation. Thus, while it would be possible to position groups of expert marksmen in suitable locations so that the hostage takers could be shot while passing between the building and the aircraft, there is no reliable technique for guaranteeing that all of the marksmen will be able to eliminate all of the hostage takers before one or more of the hostage takers can fire shots at the hostages. While it would seem possible to establish a moment in time when all of the marksmen would commence firing, that approach is not usually practical because it cannot always be predicted when the optimum exposure of the hostages will occur. It would also seem to be possible to equip groups of marksmen, which can be termed "fire teams", with radios so that a voice command to commence firing can be given from a central control location. There is, however, no reliable quick way for the person at the central control location to know when an adequate number of marksmen in the fire teams have good sight pictures of their assigned hostage takers. Thus, if the fire command is given when a hostage taker is not in the sights of any marksman, that hostage taker would be capable of inflicting severe damage on the hostages as soon as he is alerted by the commencement of fire against the others.

The foregoing example is, of course, only one of many possibilities and is presented only to illustrate some of the difficulties and considerations facing a law enforcement or military group given the most difficult and sensitive task of accomplishing a rescue of this type.

There are also various other situations in which simultaneous firing control of a number of weapons may be deemed necessary, but no effort will be made herein to expound on other possibilities.

BRIEF DESCRIPTION OF THE INVENTION

It is therefore an object of the present invention to provide a system including specially modified weapons, a central control unit and radio communication links therebetween which permits the simultaneous firing of a plurality of weapons only when a number of predetermined conditions is satisfied.

A further object is to provide such a system which provides the maximum probabilities of concurrently deactivating a plurality of hostage takers or the like with minimum danger to individuals being held as hostages.

Briefly described, the invention includes a weapon firing system for simultaneously firing a plurality of independently supported and aimed weapons comprising a plurality of weapons each having a trigger, a radio transmitter responsive to depression of said trigger to transmit a radio signal, a firing mechanism, and a radio receiver connected to said firing mechanism for operating said mechanism in response to reception of a specific fire signal along with concurrent depression of said trigger; and a control unit having receiver means for receiving signals transmitted by said transmitters in said weapons and for producing signals representative of radio signals indicative of depression on said weapons, a control transmitter for generating said specific fire signal when actuated, logic means responsive to the production of a predetermined number of signals representative of trigger depression to produce a "fire" signal, and circuit means for coupling said "fire" signal to said control transmitter to actuate said transmitter to transmit said fire signal and to thereby cause simultaneous actuation of said firing mechanism.

BRIEF DESCRIPTION OF THE DRAWINGS

In order that the manner in which the foregoing and other objects are attained in accordance with the invention can be understood in detail, an advantageous embodiment thereof will be described with reference to the accompanying drawings, which form a part of this specification, and wherein.

Figure 1:
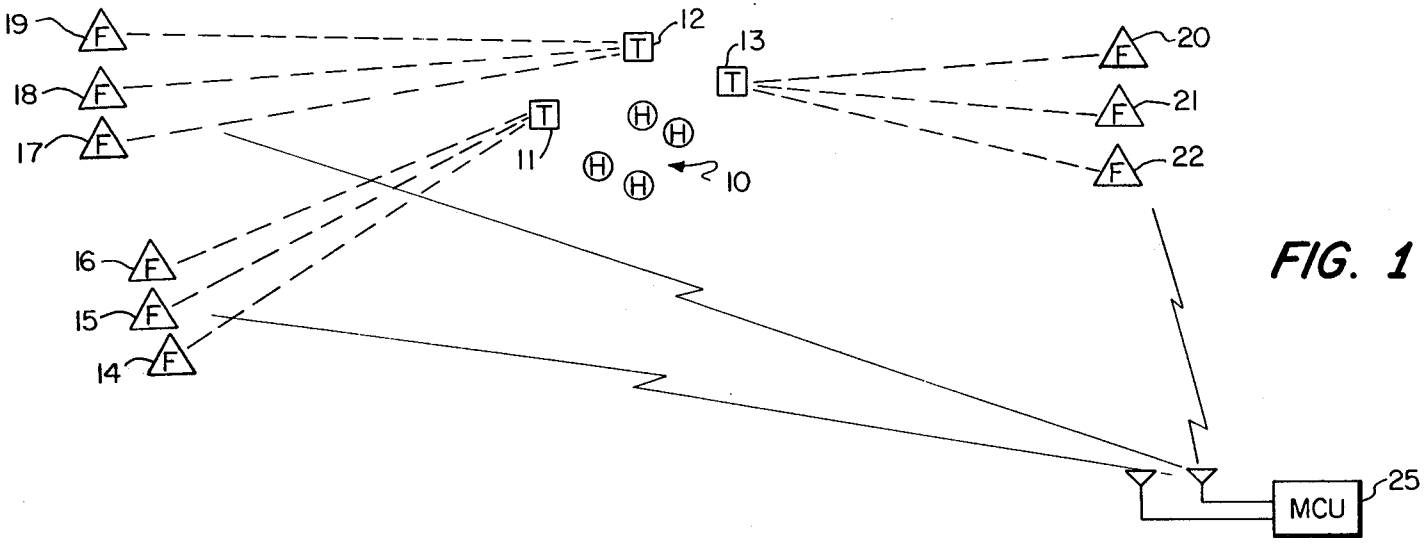
FIG. 1 is a schematic diagram illustrating a typical hostage taking situation in which a system according to the present invention is usable.

For purposes of illustration and discussion, a set of circumstances schematically illustrated in FIG. 1 will be assumed to exist. As shown in that figure, several hostages, indicated by circular symbols with the letter H therein and indicated generally at 10 will be assumed to be under the control of armed hostage takers 11, 12 and 13, the hostage takers being illustrated by squares containing the letter T. Concealed marksmen will be assumed to have been suitably located at vantage points from which they will be able to concentrate fire on selected hostage takers. The marksmen constitute fire team members illustrated by triangular symbols bearing the letter F. As indicated in FIG. 1, fire team members 14, 15 and 16 have been assigned the task of disposing of hostage taker 11, fire team members 17, 18 and 19 are to direct fire toward hostage taker 12, and fire team members 20, 21 and 22 are to direct fire against hostage taker 13. The fire teams can, of course, be disposed in relative positions other than those shown and need not be grouped together, but they are so illustrated simply for purposes of simplicity. It will also be recognized that fire teams may be accompanied by other unarmed individuals having radio equipment to facilitate moving the fire teams into position and advising them of actions to be taken, but these members do not form a part of the present invention and are therefore not illustrated.

Each member of each fire team is in two-way radio communication, through their weapons, with a master control unit 25 which can have one or more antennas for transmitting and receiving radio signals from and to the weapons carried by the fire teams.

Figure 2:
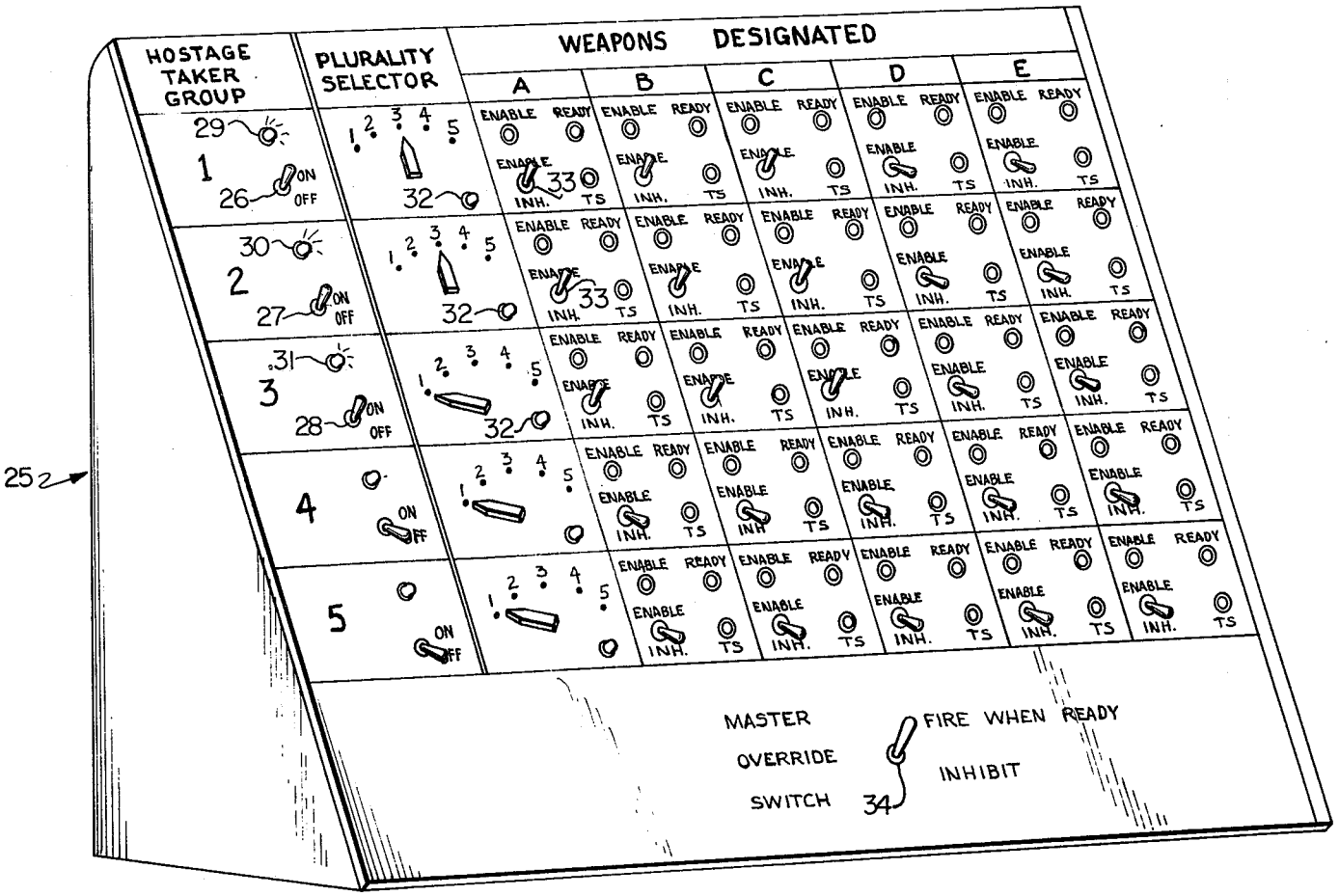
FIG. 2 is a perspective view of the front panel of a master control unit forming a part of the present invention.

A typical master control unit (MCU) has a control panel one configuration of which is illustrated in FIG. 2. The control panel is provided with numerous switches and indicator lights to permit an individual in charge of the tactical considerations and decisions dictated by the circumstances to choose the conditions under which firing of the weapons will be permitted to occur. In FIG. 2, the switches have been positioned in accordance with a representative set of circumstances to permit discussion and explanation thereof. In the example shown, the MCU is designed to control the activities of five hostage taker groups which permits control of a situation in which there are five hostage takers to be eliminated. The system can, of course, accommodate a larger number, five having been selected for purposes of illustration. Thus, at the left-hand side of the panel is a vertical column numbered 1 through 5 and headed "hostage taker group". Since three hostage takers are involved in the present example, only groups 1, 2 and 3 will be used and the logic associated only with these groups is to be employed. The MCU itself contains the logic necessary to make the prescribed decisions, as will be discussed in detail hereinafter.

Having selected groups 1, 2 and 3 to participate in the operation, the operator of the MCU moves switches 26, 27 and 28 to ON positions, thereby energizing the logic circuits associated with these groups and illuminating lamps 29, 30 and 31 indicating that the associated logic circuits are ready to function.

The second column of switches will be referred to as plurality selectors, these switches being multiple position switches movable to any one of five positions, in the present example. It should be noted that the fact that there are five positions is not related to the fact that there are five possible hostage taker groups. The plurality of selector switches are used to select the number of individuals in each team which must be in a completely ready position and condition to fire at the assigned hostage takers in order to satisfy the logic conditions necessary to operate the entire system. Thus, in the case of hostage taker group 1, the operator has selected three fire team members for that group, and it will be necessary for all three of the team members in that group to have good sight pictures and have their triggers depressed in order for the logical requirements for that portion of the system to be satisfied. Similarly, the plurality selector associated with group 2 has been placed in the number three position, requiring that all three team members of that group have good sight pictures and have triggers depressed in order for the logical requirements for that group to be satisfied.

In the case of group 3, however, it has been determined by the operator that it will be regarded as sufficient if any one of the three team members has a good sight picture and trigger depressed in connection with that particular hostage taker. Although there are three team members, the operator is not requiring that all three be in a ready position. This condition might arise, for example, where two of the hostage takers are equipped with automatic weapons such as submachine guns, but the third hostage taker is armed only with a pistol. Since the pistol is a somewhat less dangerous weapon, it will be more difficult for him to inflict serious injury, and the operator may then decide that it is sufficient to have one weapon trained on this individual. Each one of the plurality selector switches has associated with it a "plurality satisfied" indicator 32 which is illuminated when the logic in the MCU determines that the selected number of marksmen has a sight picture and has his trigger depressed.

The remaining columns on the control panel under the heading "Weapons Designated", include enable-inhibit switches 33 for each weapon. Thus, the weapon carried by fire team member 14 may be associated with switch 33 in group 1, column A, and putting that switch to the enable position permits that weapon to be actuated with the remainder of the system. As soon as the switch is moved to the enable position, the enable light in the square associated with that switch is illuminated. Each square also includes a "ready" light and a "target selected" light (abbreviated TS). The ready light is illuminated when signals are received by the receiver and logic within unit 25 indicating that the individual carrying the weapon associated with that square on the control panel has moved a switch on his weapon to the "ready" position. The individual then operates a circuit arming switch on his weapon, and the target selected light is illuminated when a trigger actuated switch on the weapon is actuated, arming the weapon and preparing it to be fired upon receipt of a "fire" command signal, as will be discussed in connection with the logic.

Finally, at the bottom of the control panel on MCU 25 is a master override switch is movable to either of a "fire when ready" position or an "inhibit" position. While in the inhibit position, the weapons cannot be fired. When the switch is moved to the "fire when ready" position, the weapons will be fired as soon as all of the necessary logical conditions are satisfied.

Figure 3:
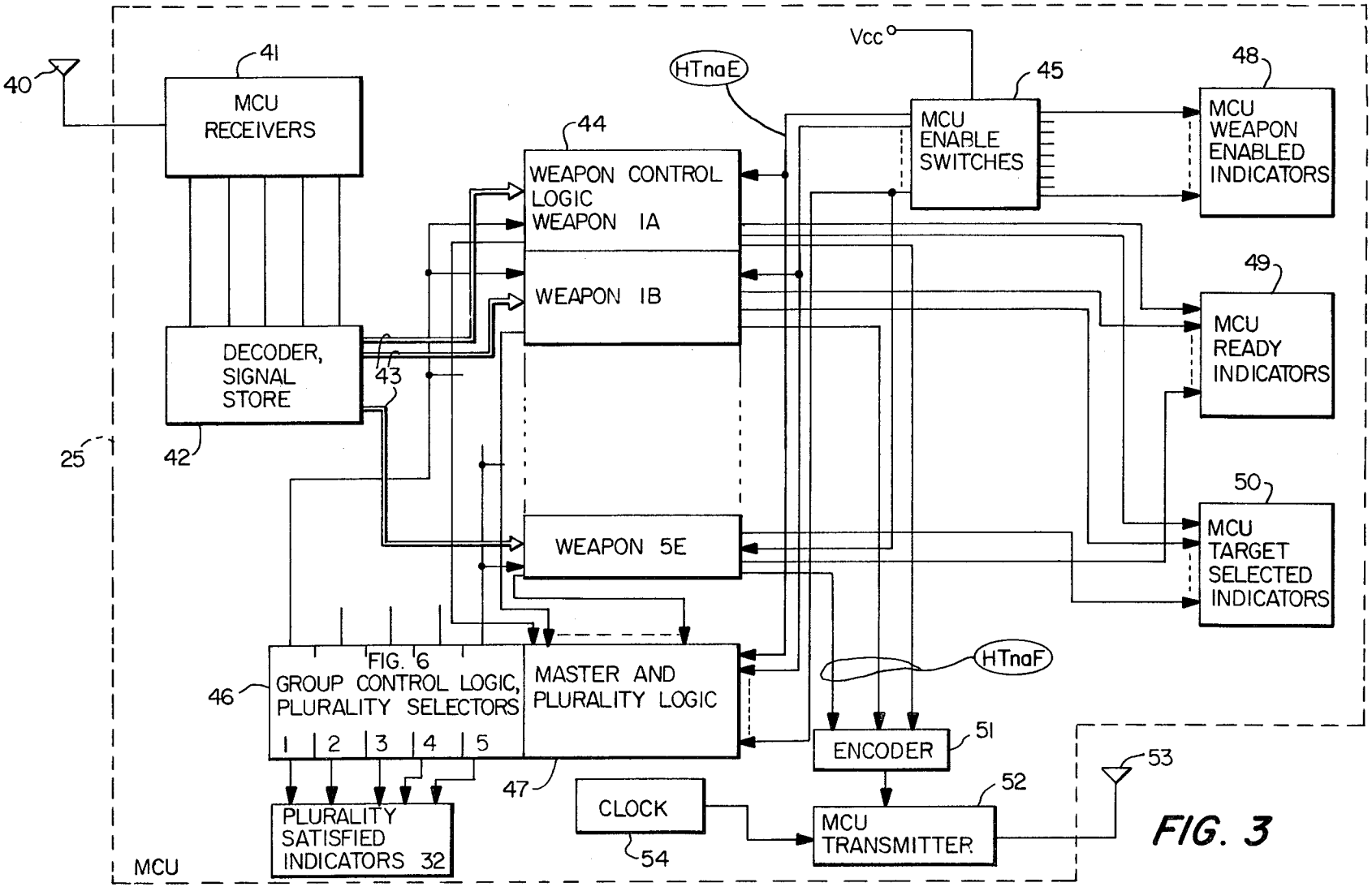
FIG. 3 is a schematic diagram, in block form, of the logic and other circuits in a master control unit according to the invention.

FIG. 3 illustrates, in block diagram form, the logic within MCU 25 which is associated with the switches and indicator lamps discussed with reference to FIG. 2. Power supplies and the like have been omitted for simplicity.

The receiving antenna 40 of the MCU is connected to a plurality of receivers 41, or a multichannel receiver, capable of receiving signals from the individual weapons. Signals from the receivers are coupled to a decoder and storage unit 42 which is capable of recognizing individual codes associated with each of the weapons and sampling and storing the signals received therefrom, as necessary. In this connection, it should be noted that no specific receiver arrangement or transmitter arrangement is disclosed herein, but various suitable systems are widely available in the art. It is necessary for the signal from each weapon to be uniquely identifiable, but this can be accomplished by assigning a specific frequency to each weapon which is recognizable by the receivers as belonging to that weapon. Alternatively, or in addition to the frequency selection, a pulse code can be used, the complexity of the code employed being a matter of selecting the level of security desired for the system. Each weapon supplies two inputs to the MCU, one input being a signal indicating that the weapon is in its "ready" condition and the other signal being representative of the fact that a target has been selected and the weapon trigger has been depressed. Thus, it is only necessary to have two different signals from each weapon recognizable.

Received signals can then be decoded and supplied on conductors 43 to weapon control logic units 44. The MCU includes one weapon control logic unit for each weapon, and one such logic unit will be discussed in detail with reference to FIG. 5. The weapon control logic units each receive the weapon ready and target selected signals from the receiver and decoder and also receive enable signals from the enable switches 26, 27, 28, . . . from the MCU front panel. The MCU enable switches are identified in FIG. 3 as block 45. In addition, the weapon control logic units receive input signals from group control logic units 46, of which five are supplied, one for each of the hostage taker groups as previously discussed in connection with FIG. 2. The group control logic units also supply outputs to the plurality satisfied indicators 32 on the front panel. A group control logic unit will be discussed in detail with reference to FIG. 6.

Figure 7:
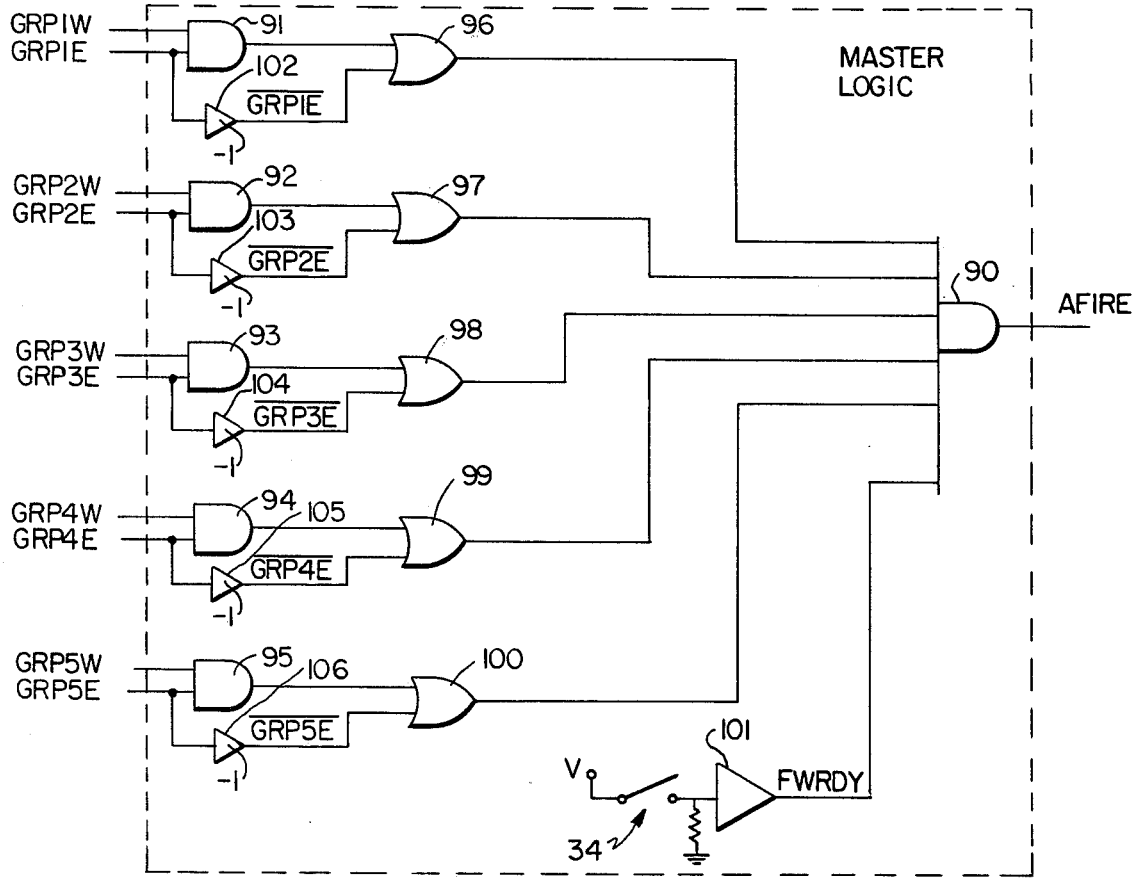
FIG. 7 is a more detailed schematic block diagram of fire signal control logic usable in the master control unit of FIG. 3.

Associated with the group control logic units are the plurality selectors and a master and plurality logic unit 47. The master logic portion thereof will be discussed with reference to FIG. 7 and the plurality logic will be discussed with reference to FIG. 8. The master and plurality logic receives inputs from the weapon control logic unit and also receives inputs from enable switches 45 as indicated in FIG. 3. The enable switches also provide outputs to the weapon enabled indicators on the front panel, these indicators being identified in FIG. 3 as unit 48.

The weapon control logic units provide outputs to the ready indicators 49, there being one ready indicator for each weapon in each group, and to target selected indicators 50, one of which is also supplied for each weapon. Finally, the weapon control logic units provide fire signal outputs to an encoder 51 which codes the signals in a form recognizable to each individual weapon and supplies these to the MCU transmitter 52 which transmits the signals on an antenna 53.

The MCU transmitter is also supplied with a clock 54 and a "polling" timer which can supply an interrogation output, typically once each second, to all of the weapons causing the weapons to respond with signals indicating the conditions of readiness or target selected.

Figure 5:
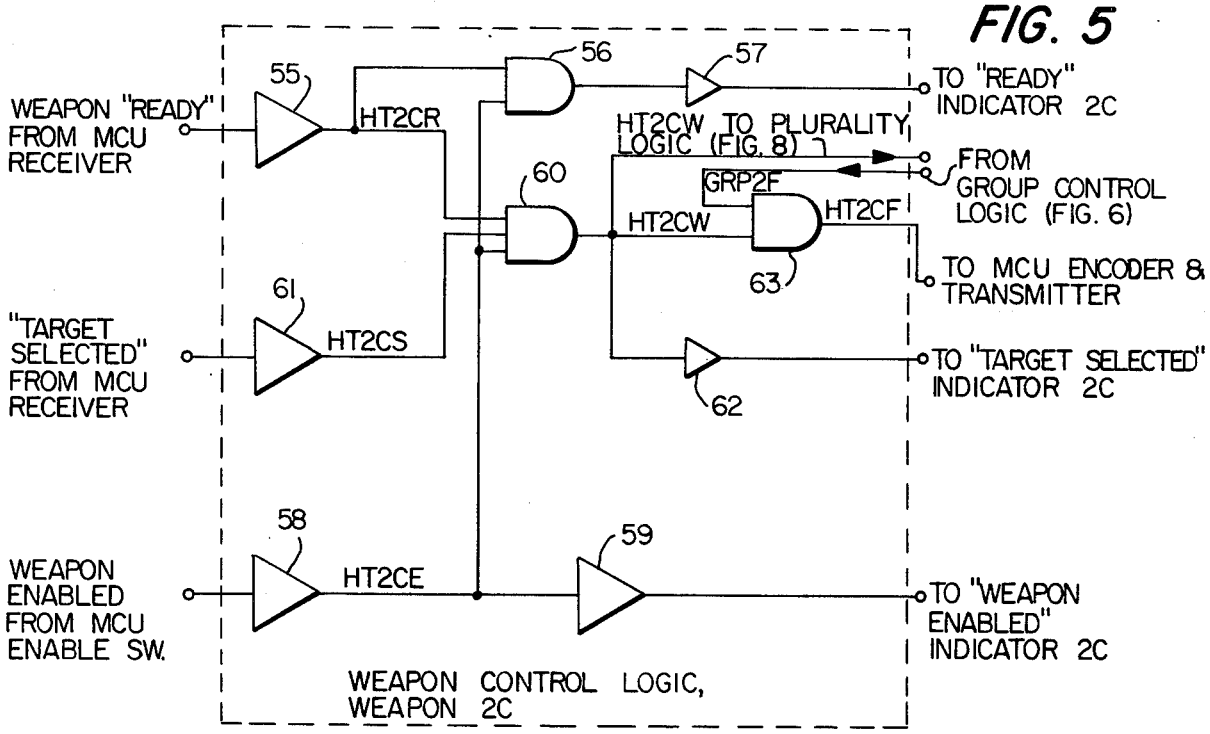
FIG. 5 is a more detailed schematic block diagram of weapon control logic usable in the master control unit of FIG. 3.

In order to more fully understand the overall operation of the logic units generally illustrated in FIG. 3, reference will be made to each of the units individually. As shown in FIG. 5, the weapon control logic units each include amplifiers and gates for recognizing and combining the various signals. As an example, the logic unit for weapon 2c is illustrated. The weapon ready signal, when received, is supplied by the MCU receiver to a buffer amplifier 55 from which it is coupled to one input of an AND gate 56. As is well recognized, a gate circuit of this type produces an output only when all of its inputs are "true". When present, the output of gate 56 is coupled through an amplifier 57 to an output which is connected to the ready indicator associated with weapon 2c on the front panel of unit 25. The weapon enabled signal from the MCU enable switch associated with weapon 2c is supplied to an amplifier 58 which produces an output coupled through an amplifier 59 to the weapon enabled indicator associated with weapon 2c. The output of amplifier 58 is also coupled to the other input of AND gate 56 and to one input of an AND gate 60. The output of amplifier 55 is coupled to a second input of gate 60. The target selected signal from the receiver is coupled through an amplifier 61 to the third input of gate circuit 60, the output of which is coupled through an amplifier 62 to the target selected indicator associated with weapon 2c, and also to one input of an AND gate circuit 63. The output of gate 60 is also coupled to the plurality logic circuit shown in FIG. 8, to be discussed hereinafter. Finally, an input from the group control logic circuit (FIG. 6) is supplied to the other input of gate circuit 63, the output of which is supplied as a fire signal to the MCU encoder and transmitters 51 and 52, respectively.

At this point, it will be convenient to discuss the code system which is employed to identify the various signals in this system. Each code begins with letters indicating a weapon or group, the letters HT indicating a weapon and the letters GRP indicating a group. These letters are followed by a number indicating the group, in either case, followed by a letter indicating which weapon in the group is involved, depending upon the prefix letters. Finally, there is a letter or group of letters indicating the nature of the signal. Thus, the output of amplifier 55, HT2CR indicates that the signal is a ready signal associated with the weapon 2c assigned to a fire team member. Similarly, HT2CS indicates a target selected signal from weapon 2c, and HT2CE indicates that weapon 2c has been enabled.

When signals are gated together, the final letter changes, so that when HT2CR, S and E are gated together, the result is HT2CW, indicating a complete readiness in the weapon. Gating HT2CW together with GRP2F (a group 2 fire readiness signal) produces HT2CF, a fire signal for weapon 2c. As will be seen, a signal such as HT2CF will not be produced for any one weapon unless it is simultaneously being produced for all weapons.

Figure 8:
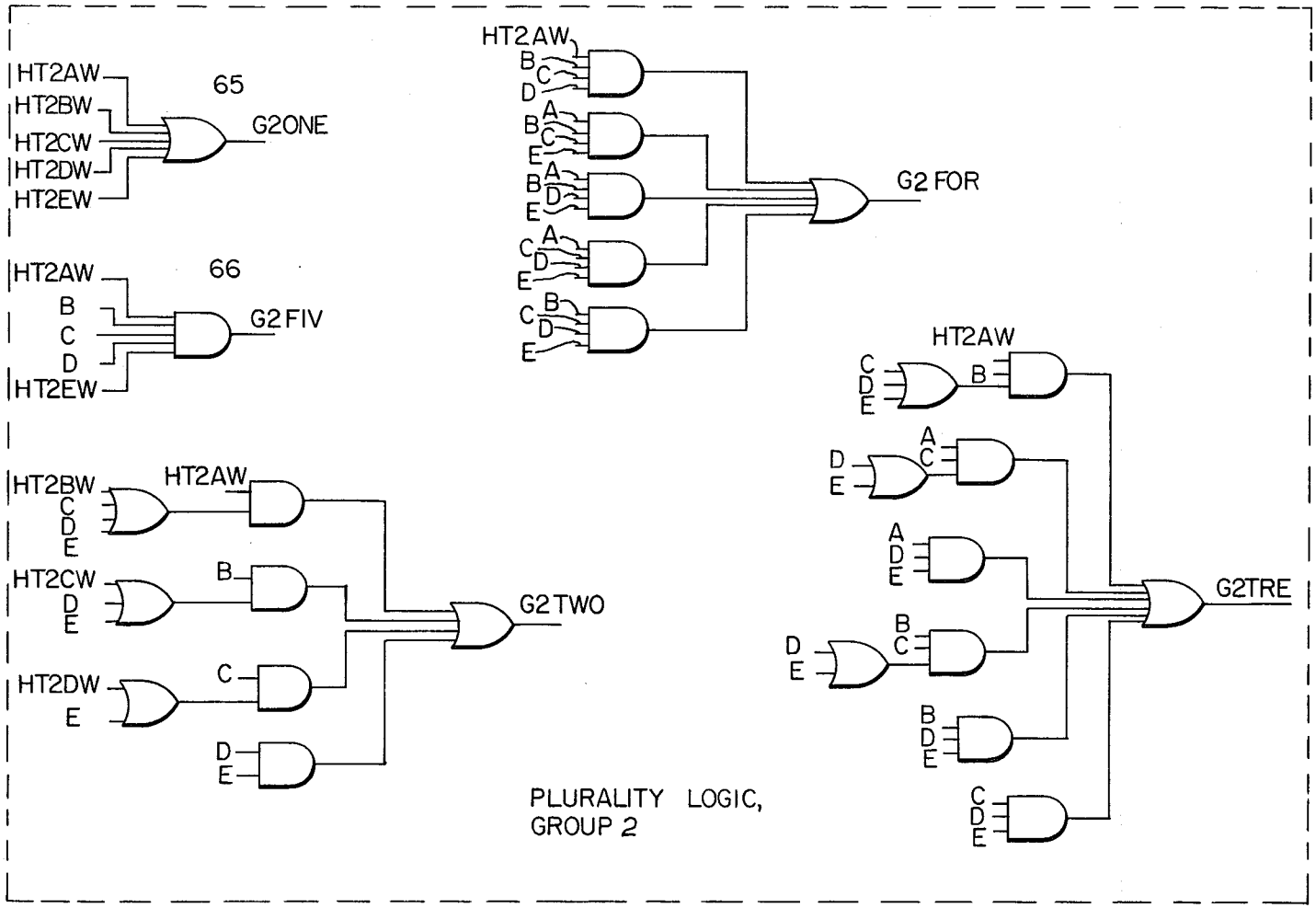
FIG. 8 is a more detailed schematic block diagram of plurality logic usable in the master control unit of FIG. 3.

The signal HT2CW from gate 60 is, as previously indicated, supplied to the plurality logic shown in FIG. 8, along with similar signals from the other 24 weapon control logic circuits. As shown in FIG. 8, the plurality logic includes five sets of gates, each of which is designed to produce an output when certain combinations of conditions exist. The plurality logic includes an OR gate 65 which produces an output G2ONE which indicates that it has received an input from at least one of the weapons in hostage taker group 2 of the type HT2AW, HT2BW, or the like. This G2ONE signal is supplied to the group control logic for group 2, shown in FIG. 6, and will be matched with a selected number chosen by the plurality selector associated with hostage taker group 2.

At the other end of the spectrum, and AND gate 66 will produce an output G2FIV only when it receives inputs from all of the five weapon control logic circuits associated with hostage taker group 2, gate 66 being an AND gate. Thus, an output from gate 65 indicates that a plurality one situation can be satisfied while an output from gate 66 indicates that a plurality five situation can be satisfied.

In between these extremes, more complex logic is required to assure satisfaction of pluralities of two, three or four. However, the logic is quite straightforward, and, noting that the functions in FIG. 8 are abbreviated to single letters for diagram simplicity, an examination of the logic will reveal that the following summary of each operation exists.

GnONE+ is generated whenever any one of the weapon W functions ae true:

$$GnONE=A+B+C+D+E$$

GnTWO is generated whenever any two of the weapon W functions are true:

$$GnTWO=A.(B+C+D+E)+B.(C+D+E)+C.(-D+E)+(D.E.)$$

GnTRE is generated whenever any three of the weapon W functions are true:

$$GnTRE=A.B.(C+D+E)+A.C.(D+E)+(A.D-.E)+B.C(D+E)+(B.D.E)+(C.D.E)$$

GnFOR is generated whenever any four of the weapon W functions are true:

$$GnFOR=(A.B.C.D)+(A.B.C.E)+(B.C.D.E)+-(A.B.D.E)+(A.C.D.E)$$

GnFIV is generated whenver all five of the weapon W functions are true:

$$GnFIV=A.B.C.D.E$$

Figure 6:
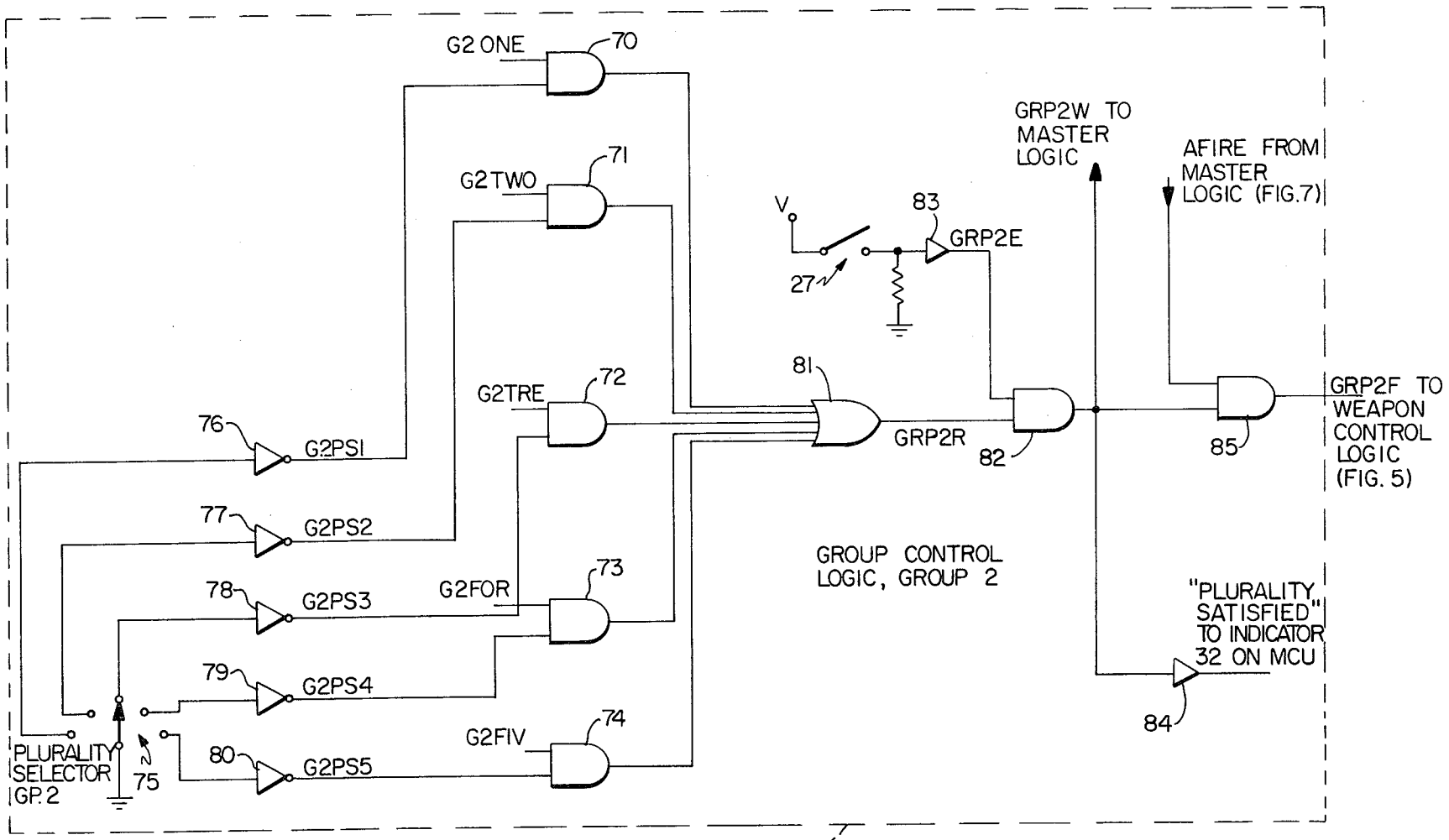
FIG. 6 is a more detailed schematic block diagram of group control logic usable in the master control unit of FIG. 3.

The output signals thus derived are connected to the group control logic of which, as previously indicated, five exist in the MCU. The logic for group 2 is shown in FIG. 6 and it will be seen that the signals developed by the plurality logic are connected respectively to one input of each of gates 70, 71, 72, 73 and 74, each of these being AND gates. The plurality selector switch 75 for group 2 includes a movable contact which is connected to ground and which is movable to any one of five fixed contacts which are individually connected to inverting amplifiers 76–80, the outputs of these amplifiers being respectively connected to the other inputs of AND gates 70–74. As will be recognized, when the input to any one of these amplifiers is grounded through the movable contact of switch 75, the output thereof is a "true" signal. In the example shown, an output from amplifier 78 is connected to the input of gate 72. Thus, when the G2TRE is provided from the plurality logic of FIG. 8, AND gate 72 provides an output signal. All of the outputs of gates 70–74 are connected to the inputs of an OR gate 81 so that when any of the AND circuits provides an output, gate circuit 81 provides an output to one input of an AND circuit 82, indicating that the plurality selected by switch 75 has been satisfied. The other input to AND circuit 82 is provided from the enable switch 27 of the group 2 circuit through an amplifier 83. Thus, when the plurality has been satisfied and an output is provided from OR gate 81, an output is provided from gate 82. This output is coupled through an amplifier 84 to the plurality satisfied indicator 32 on the master control unit front panel. The output is also supplied to an AND gate 85 and to the master logic circuit of FIG. 7. As will be described, when the group 2 weapons have been enabled, the master logic responds to the enabling signal and to the GRP2W signal from gate 82 to provide an AFIRE signal back to the group control logic, providing the second input to gate 85. Gate 85 then provides a GRP2F signal to the weapon control logic of FIG. 5 which, when the other signals are provided thereto as previously discussed, sends an HT2CF signal to the MCU encoder and transmitter for transmission to the weapon selected.

The master logic circuit (FIG. 7) includes a main AND gate 90 which produces the AFIRE output signal upon receipt of appropriate signals from five circuits including AND gates 91–95 and OR gates 96–100, and also from an amplifier 101. Amplifier 101 receives its input from switch 34 which is the master override switch on the front panel. That switch is closed when placed in the "fire when ready" position, and the amplifier produces the signal FWRDY continuously when that switch is closed. Each of the other circuits is associated with a specific group and provides an output when two input conditions are satisfied, one of the inputs being the GRP2W signal supplied by gate 82 in the group control logic of FIG. 6. The other input to each of gates 91–95 is the "enable" signal which is connected to its associated gate and is also connected through one of inverting amplifiers 102–106. Using the group 2 circuit as an example, if group 2 is selected, then a "true" signal is supplied to one input of AND gate 92. With this being the case, no output is supplied by amplifier 103, and there is no output from OR gate 97. Thus, regardless of what conditions exist at the outputs of the other OR gates 96 and 98–100, there will be no output from AND gate 90 until an output is supplied from AND gate 92. That output will appear only when the plurality selected has been satisfied and an output is supplied by gate 82 in the group control logic. As soon as that GRP2W signal is supplied, there is an output from gate 92 which is coupled through OR gate 97 to the input of AND gate 90. If, however, group 2 is not selected, and its enable switch is left in the off position, there is no GRP2E input to gate 92 and amplifier 103 supplies a "substitute" input through OR gate 97 to AND gate 90 so that as soon as the necessary conditions are satisfied for the selected weapons, gate 90 can supply the AFIRE output.

Thus, it is the master logic circuit which makes sure that conditions are satisfied for all of the chosen weapon groups before supplying the AFIRE signal to all of the group control logic circuits, permitting transmission of a signal therefrom to the weapon control logic and, thence, to the MCU encoder and transmitter. In the example previously discussed with the switches in the positions shown in FIG. 2, enable inputs are present at gates 91, 92 and 93, but no enable inputs are supplied to gates 94 and 95. Thus, before any weapons are ready, outputs are provided from OR gates 99 and 100 to AND gate 90. Then, when the master switch is moved to the fire when ready position, an output from amplifier 101 is coupled to gate 90, and all that remains is for the appropriate signals to appear from the OR gates for the selected groups, i.e., gates 96, 97 and 98. As soon as the weapon ready, target selected and enable conditions are satisfied by the weapon control logic, and the plurality logic determines that the desired number of weapons are appropriately trained on the hostage takers and the triggers thereof are depressed, the GRP1W, GRP2W and GRP3W signals are supplied to gates 91–93, respectively, producing outputs from gates 96–98, completing all of the inputs to gate 90. The AFIRE signal is then supplied to gate 85 (for each group control logic circuit) and GRP1F, GRP2F and GRP3F signals are supplied to the gates 63 of the weapon control logic circuits for groups 1–3, producing an HT1CF, HT2CF and HT3CF signals to the MCU encoder and transmitter, which signals cause simultaneous transmission of a "fire command" signal from the MCU transmitter to all weapons. All selected weapons which have their triggers depressed are then fired simultaneously, disabling the hostage takers.

Figure 4:
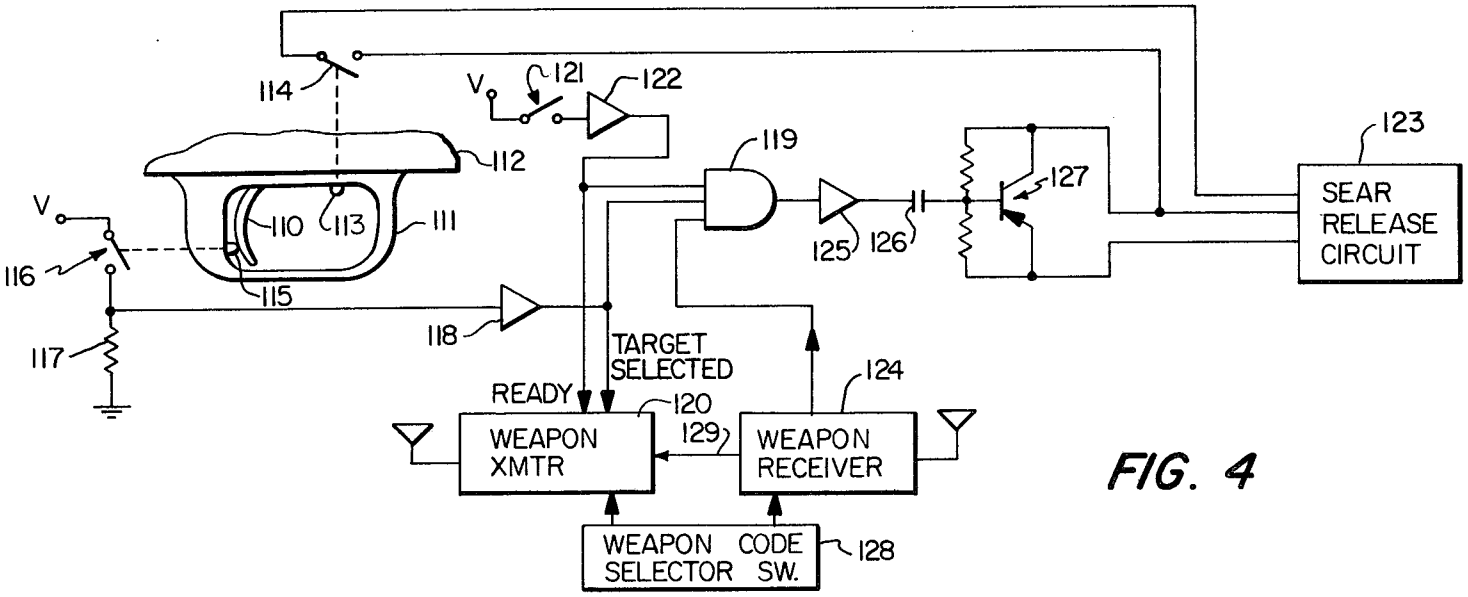
FIG. 4 is a schematic diagram, partly in block form, of apparatus mounted on each weapon used in a system according to the invention.

The remaining element of the system is the weapon itself which, obviously, must be modified to respond only to the signals generated by the MCU along with trigger depression. As shown in FIG. 4, the weapon is a specially modified weapon which incorporates an electrical sear release controlled by an electronic circuit. An electrical trigger mechanism which is usable in this fashion, with some modification, is manufactured and sold by Electronic Trigger Systems, Route 2, Box 114A, Montrose, Colorado 81401. This mechanism includes a special trigger housing, two switches and a sear release circuit which includes a small solenoid coupled to the sear release itself, a silicon controlled rectifier (SCR) connected to energize the solenoid, and a capacitor discharge circuit to trigger the SCR. A small battery is incorporated to charge the capacitor. Since this mechanism is a purchased item and is not part of the invention as such, most of it is only diagrammatically illustrated in FIG. 4. However, it is necessary to modify the device and incorporate other elements for the weapon to be usable in the system of the present invention.

As shown in FIG. 4, the trigger housing includes a trigger 110, a trigger guard 111, and a small housing 112 attached to the trigger guard for holding switches. A button switch 113 is mounted in the upper portion of the trigger guard forward of the trigger and is mechanically connected to a latching switch 114 which is coupled to the sear release circuit. Behind trigger 110 is a push button 115 which, upon very small motion, closes a switch 116 which is connected in series with a resistor 117 between a source of voltage and ground. An amplifier 118 is connected to the junction between switch 116 and 117 and provides an output signal to one input terminal of an AND gate 199 and also to a small radio transmitter 120 which is mounted in the weapon, (or, if desired, separately carried by the marksman) and which is coupled to receiver 41 in the MCU. Button 115 and switch 116 comprise the trigger switch and the signal generated by actuation of switch 116 constitutes the "target selected" signal which is supplied to the weapon transmitter and the MCU. An additional switch 121, in the nature of a "safety" is connected between a source of voltage and an amplifier 122, the output of which is also supplied to another input of gate 119 and to weapon transmitter 120, the signal from amplifier 122 constituting the "ready" signal from the weapon. In a tactical situation, switch 121 would be closed by the fire team member as soon as he is in a position from which he can fire the weapon at his assigned hostage taker, letting the master operator know, by illumination of the "ready" light associated with this weapon that he needs only to obtain a sight picture and depress his trigger. Button 113 is then depressed, closing switch 114 which activates the sear release circuit 123 to the extent of charging the capacitor which will fire the SCR. The weapon is now in a condition of readiness and needs only an input from the MCU through weapon receiver 124, this input constituting the third input to gate 119. As soon as that signal is received, gate 119 produces an output which is coupled through an amplifier 125 and a capacitor 126 to a small amplifier circuit including a transistor 127 to the sear release circuit, discharging the capacitor into the SCR and energizing the solenoid which releases the sear and fires the weapon.

It will be observed that one of the inputs to gate circuit 119 is the signal from trigger switch 116. Thus, the weapon team member exercises final control over whether or not his weapon is fired. Thus, if a hostage should suddenly be moved between the weapon team member and his target, he can release the trigger and, even if the other weapons in the system fire, his will not be fired. As previously discussed, if his weapon is necessary to satisfy the plurality, none of the weapons will be fired; but if his weapon is a superfluous weapon as in the case of group 3, the others can fire, but his will not, thereby introducing a safety factor.

It should further be pointed out that sear release circuit 123, button 113, switch 114, button 115, switch 116, resistor 117 and amplifier 118 along with the housing, trigger guard and trigger assembly are all components of the purchased unit produced by the above-mentioned company. In order to modify this system to be operative as described, it is only necessary to introduce the intervening logic and amplifier circuit, a modification which can be accomplished by severing the interconnecting wires between components and making connections as shown. The modification of the weapon itself, to install the special trigger housing and the like, are accomplished in accordance with instructions supplied by Electronic Trigger Systems.

It will also be observed in FIG. 4 that the weapon includes a weapon code selector switch 128 which can be used to select the frequency or pulse code unique to that weapon so that it will be responsive only to signals supplied by the MCU. It will also be observed that the receiver can be designed, as previously indicated to receive an interrogation code which is coupled on conductor 129 to weapon transmitter 120, providing no input to AND circuit 119. Upon receipt of this signal, the weapon transmitter can respond by indicating the presence or absence of "ready" or "target selected" signals for transmission to the MCU.

Normally, the weapons used in a system of this type would be modified sniper-type rifles having accuracy and firepower consistent with the goals of the system. No effort has been made herein to exhaustively discuss the various tactical circumstances or considerations involved in the use of such a system. However, it will be readily apparent that the system provides a degree of safety and level of operability not previously available and would therefore have excellent application in firing range safety or live firing exercises.

While one advantageous embodiment has been chosen to illustrate the invention, it will be understood by those skilled in the art that various changes and modifications can be made therein without departing from the scope of the invention as defined in the appended claims.

What is claimed is:

1. A weapon firing system for simultaneously firing a plurality of independently supported and aimed weapons comprising a plurality of weapons each having a trigger, a weapon radio transmitter responsive to depression of said trigger to transmit a radio signal, a firing mechanism, and a radio receiver connected to said firing mechanism for operating said mechanism in response to reception of a specific fire signal along with concurrent depression of said trigger; and a control unit having receiver means for receiving signals transmitted by said transmitters in said weapons and for producing signals representative of radio signals indicative of trigger depression on said weapons, a control radio transmitter for generating said specific fire signal when actuated, logic circuit means responsive to the production of a predetermined number of signals representative of trigger depression for producing a "fire" signal; and circuit means for coupling said "fire" signal to said control transmitter to actuate said transmitter to transmit said fire signal and to thereby cause simultaneous actuation of said firing mechanism, and wherein each of said weapons further includes a ready switch operated independently of said trigger and means responsive thereto for causing said weapon radio transmitter to transmit a signal indicative of movement of said ready switch to a ready position.

2. A weapon firing system for simultaneously firing a plurality of independently supported and aimed weapons comprising a plurality of weapons each having a trigger, a weapon radio transmitter responsive to depression of said trigger to transmit a radio signal, a firing mechanism, and a radio receiver connected to said firing mechanism for operating said mechanism in response to reception of a specific fire signal along with concurrent depression of said trigger; and a control unit having receiver means for receiving signals transmitted by said transmitters in said weapons and for producing signals representative of radio signals indicative of trigger depression on said weapons, a control radio transmitter for generating said specific fire signal when actuated, logic circuit means responsive to the production of a predetermined number of signals representative of trigger depression for producing a "fire" signal; and circUit means for coupling said "fire" signal to said control transmitter to actuate said transmitter to transmit said fire signal and to thereby cause simultaneous actuation of said firing mechanism, and wherein said control unit further comprises first switch means for selecting the number of groups of weapons to form a part of the system at any one time;

second switch means for selecting the number of weapons to be included in each group; and third switch means for selecting the number of weapons in each group from which trigger depression signals must be received, said logic circuit means being responsive to said signals to produce a "fire" signal only when the conditions established by said first, second and third switch means are satisifed.

3. A system according to claim 2 wherein each of said weapons includes a ready switch and means for causing said weapon radio transmitter to transmit a signal indicative of movement of said ready switch to a ready position.

4. A system according to claim 3 wherein said logic circuit means includes a plurality of weapon control logic circuits, one of said circuits being operatively associated with each of said weapons, each of said weapon control logic circuits being adapted to receive an enabling signal from an associated portion of said second switch means, a signal indicative of movement of the ready switch to the ready position in the weapon associated with said circuit, and a trigger depression signal from said associated weapon to produce a signal representative of complete readiness of said weapon to fire; and logic circuits for recognizing that the weapon control logic circuits associated with all selected weapons are producing signals representative of weapon readiness for producing said "fire" signal.

5. A system according to claim 2 wherein said control unit further includes fourth switch means movable between a first position in which production of a "fire" signal is prevented and a second position in which production of said fire signal is permitted when said conditions are satisifed.

* * * * *